US009328551B2

(12) United States Patent
Henderson et al.

(10) Patent No.: US 9,328,551 B2
(45) Date of Patent: May 3, 2016

(54) SAFETY GATE ASSEMBLY

(71) Applicant: Summer Infant (USA), Inc., Woonsocket, RI (US)

(72) Inventors: William A. Henderson, Holden, MA (US); Mark J. Sousa, Hope, RI (US)

(73) Assignee: Summer Infant (USA), Inc., Woonsocket, RI (US)

( * ) Notice: Subject to any disclaimer, the term of this patent is extended or adjusted under 35 U.S.C. 154(b) by 0 days.

(21) Appl. No.: 14/294,202

(22) Filed: Jun. 3, 2014

(65) Prior Publication Data

US 2014/0373448 A1 Dec. 25, 2014

Related U.S. Application Data

(60) Provisional application No. 61/838,737, filed on Jun. 24, 2013.

(51) Int. Cl.
*E06B 9/04* (2006.01)
*E06B 9/00* (2006.01)

(52) U.S. Cl.
CPC ..... *E06B 9/04* (2013.01); *E06B 2009/002* (2013.01)

(58) Field of Classification Search
USPC ..... 49/55
IPC ..... E06B 2009/002,9/04, 9/02
See application file for complete search history.

(56) References Cited

U.S. PATENT DOCUMENTS

| | | | | |
|---|---|---|---|---|
| 2,594,864 | A * | 4/1952 | Gibson et al. | 160/351 |
| 3,163,205 | A * | 12/1964 | Gottlieb | 160/216 |
| 4,944,117 | A * | 7/1990 | Gebhard et al. | 49/55 |
| 5,052,461 | A * | 10/1991 | Stern | 160/224 |
| 5,272,840 | A * | 12/1993 | Knoedler et al. | 49/463 |
| 5,367,829 | A * | 11/1994 | Crossley et al. | 49/465 |
| 5,442,881 | A * | 8/1995 | Asbach et al. | 49/465 |
| 5,528,859 | A * | 6/1996 | Taylor et al. | 49/55 |
| 5,531,258 | A * | 7/1996 | Poulson et al. | 160/376 |
| 5,575,113 | A * | 11/1996 | Huang | 49/55 |
| 5,782,039 | A * | 7/1998 | Scherer et al. | 49/465 |
| 5,829,505 | A * | 11/1998 | Brescia | 160/225 |
| 5,924,242 | A * | 7/1999 | Macari et al. | 49/55 |
| 6,435,250 | B1 | 8/2002 | Pichik | |
| 6,446,395 | B2 | 9/2002 | Rogers | |
| 6,907,914 | B1 | 6/2005 | Lundh | |
| 7,219,709 | B1 | 5/2007 | Williams | |
| 2004/0045222 | A1 | 3/2004 | Hicks | |
| 2007/0144691 | A1 * | 6/2007 | Yates | 160/377 |

(Continued)

FOREIGN PATENT DOCUMENTS

WO W094/00664 1/1994

OTHER PUBLICATIONS

Author unknown, no title. Document is pdf of Baby's Journey One Step Safety Gate Product web page downloaded from the internet May 2014.

*Primary Examiner* — Gregory Strimbu
(74) *Attorney, Agent, or Firm* — Chace Ruttenberg & Freedman

(57) ABSTRACT

A safety gate is composed of a U-shaped frame and a door spanning the interior of the frame. One side of the door is pivotally connected to one side of the frame to permit pivotal movement of the door with respect to the frame. The frame's width is adjusted by a ratchet mechanism composed of a spring-loaded pawl having a sloping side and a vertical side so that the width of the frame can be adjusted in one direction only.

7 Claims, 5 Drawing Sheets

(56) References Cited

U.S. PATENT DOCUMENTS

2008/0284180 A1 11/2008 Newcombe
2009/0158665 A1* 6/2009 Wu ..... 49/55
2011/0088323 A1 4/2011 Lundh
2012/0211182 A1 8/2012 Pilgrim

* cited by examiner

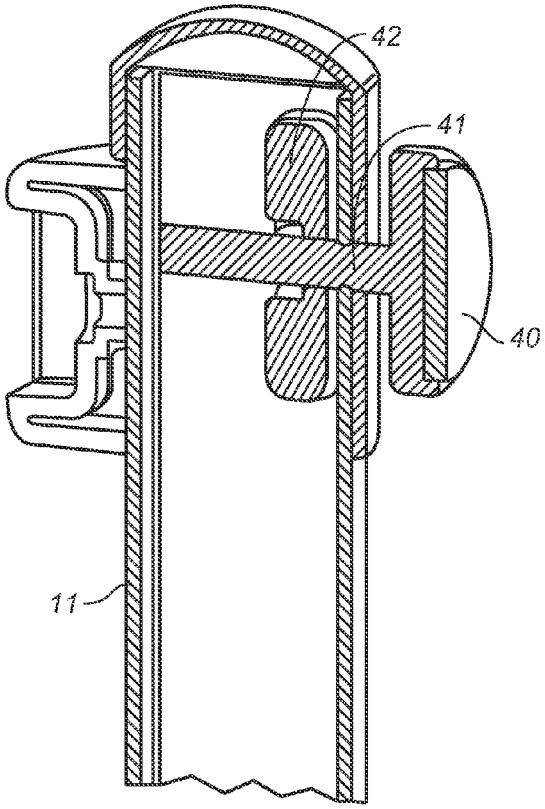
FIG. 4
FIG. 5
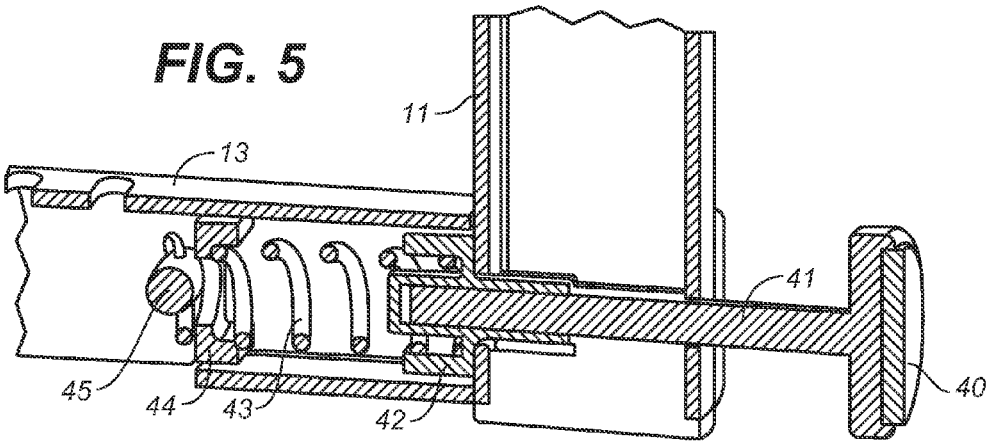

SAFETY GATE ASSEMBLY

FIELD OF THE INVENTION

The invention is in the field of safety gates.

BACKGROUND OF THE INVENTION

Safety gates for confining children or pets are known. In some, the gate is composed of two panels which expand to fill a door or hall way and clamp in place against the door jamb or walls by a ratchet or pawl-type mechanism consisting of two poles one of which is provided with a series of regularly spaced slots and the other of which is provided with a hinged member able to sit in the slots. The mechanism is attached to the vertical mid-point of each panel and extends horizontally from one side end of the first panel to the other side end of the second panel. The adjustment to fit the gate is by hand. The hinged member is lifted vertically while the panels are expanded to fit. Then the member is lowered into a slot. Often this adjustment takes two or three or more tries to get right, especially if one person is setting the gate in place.

In other safety gates, the gate is mounted on a hinged U-shaped frame and the frame is adjusted to fill the door or hall way by means of a plurality of screw pads on the frame. Typically there are four screw pads, one each at the top and bottom of one side of the frame and one each at the top and bottom of the other side of the frame, and to properly mount this type of gate each of the screw pads must be unscrewed in a fairly even manner.

It would be advantageous to provide a safety gate that eliminates the above-noted problems with known safety gates. Such a gate is provided by this invention.

SUMMARY OF THE INVENTION

The safety gate of the invention includes a U-shaped frame and a gate spanning the interior of the U, one side of which is pivotally connected to one side of the frame to permit pivotal movement of the gate with respect to the frame about a pivot axis. The frame includes two generally vertically extending pillars, each pillar having a substantially perpendicular cross bar attached to it and extending horizontally at the bottom end to form the bottom of the U. At least one of the vertically extending pillars is canted outward 1°-3°, preferably both pillars are canted outward. This is to ensure a pre-load compression on the top portion of the frame to apply pressure on the doorway sides when the gate is positioned. To position the gate assembly, the user pulls inward both the left and right pillar at the top to bend the pillars inward and positions the pillars against the doorway vertical surfaces and releases them. This ensures grip to resist any pushing on the U-frame to dislodge it. Positioned at or near the upper end of each pillar on the outer side of the frame are pads to keep the pillars from marring the door or hall way. Pads are also positioned at or near the lower end of each pillar for the same purpose.

The frame further includes a hollow surround bar that is positioned surrounding the horizontal cross bars so that each horizontal cross bar rests at least partially inside it and is able to move in a telescoping manner within it. The cross bars may be U-shaped in cross section and are attached to the vertically extending pillars so that the bottom of the U is uppermost in an upside down arrangement. At least one of the cross bars is formed with an array of spaced apart catches in one side thereof, preferably the top side thereof. The catches are disposed in the cross bar in regular increments, preferably in increments of between 10 and 15 mm, more preferably in increments of between 12 to 13 mm. The catches may be in the form of hollow slots in the top side of the cross bar or in the form of downwardly extending saw teeth in the top side of the cross bar. The cross bars and surround bar form part of a gross adjustment mechanism by which one of the pillars separates from the other pillar in these regular increments. A door, formed to span the interior of the frame and pivotally connected to an interior side of one of the frame pillars to permit pivotal movement of the door with respect to the frame about a pivot axis is also provided. The door is formed so as to be adjustable in the horizontal direction such that the width of the door can accommodate the varying widths of the frame.

The safety gate of the invention further includes uni-directional locking means for releasably securing the cross bars within the surround bar. In one embodiment, the uni-directional locking means includes a rotating or pivoting lock pawl pivotally mounted in the interior of the surround bar and being formed and positioned to rotate or pivot in one direction when the frame is expanded to engage one of the catches in the cross bar and to lock the frame when rotated in the opposite direction. In an alternate embodiment, the uni-directional locking means includes a linear lock pawl mounted in the interior of the surround bar and being formed and positioned to move linearly in one direction when the frame is expanded to engage one of the catches in the cross bar and to lock the frame when rotated in the opposite direction. The catches may be an array of slots or saw teeth in the top or upper portion of the catched cross bar.

The safety gate also includes a cantilever foot pedal operatively connected to the unslotted cross bar and to the surround bar to pivot between an upward and open, unlocked position and a downward and closed, locked position to telescopingly move the surround bar to the unslotted cross bar and engage the locking means to lock and unlock the frame. When the user steps on the foot pedal to lock the gate frame in place, the foot pedal pivots downward using an over-center geometry and pushes the unslotted cross bar and surround bar outward, expanding the U-frame and gate assembly outward to push the bottom pads, one of which is spring-loaded, against the vertical doorway surfaces. This ensures that the unit resists the bottom of the U-frame from being dislodged when a force is applied to the bottom of the gate or frame. This foot pedal is secured in the downward, locked position by means of two spring-loaded finger locks, one on each side of the pedal to ensure it stays locked and only is released when the user purposefully depressed both locks at the same time, to allow the foot pedal to move in an upward and unlocked position. When the pedal is released and allowed to pivot back upward, the unslotted cross bar and the surround bar retract and remove the load off the bottom pads which allows the user to remove the frame from the doorway.

One of the pads included to prevent marring of the structure in which the gate is mounted is spring-loaded. The pad positioned outside of the pillar at the pillar bottom opposite the foot pedal includes a spring positioned within the slotted cross bar and operatively connected to the pad such that when the foot pedal is depressed the spring is compressed and increases the load on the pad. The spring loaded pad has a spring which deforms under load to take up compliance when the two pillars are expanded by the foot pedal. This spring-loaded pad allows the pad to depress under a load of 30 foot pounds. As the U-frame members expand when the foot pedal is depressed, this pad makes contact with the passageway vertical surface and the spring allows the arm member to continue to expand, compressing the spring, and keeping the pads in contact with the passageway vertical surface. As the spring compresses, the load on the pads increases, which ensures adequate friction between the product and the passageway vertical surfaces.

The safety gate also include a latch assembly composed of upper and lower latches positioned at the opening side of the gate and corresponding upper and lower latch receivers positioned on the frame pillar opposite for receiving the latches to releasably latch the door in a closed planer position in relation to the frame. The form of the latch assembly is not critical; appropriate one for this purpose are known to those skilled in the art.

DETAILED DESCRIPTION OF THE DRAWINGS

FIG. 4 is an exploded, cross-sectional view of the area denoted B in FIG. 1.

FIG. 5 is an exploded cross-sectional view of the area denoted C in FIG. 1.

DETAILED DESCRIPTION

Figure 1:
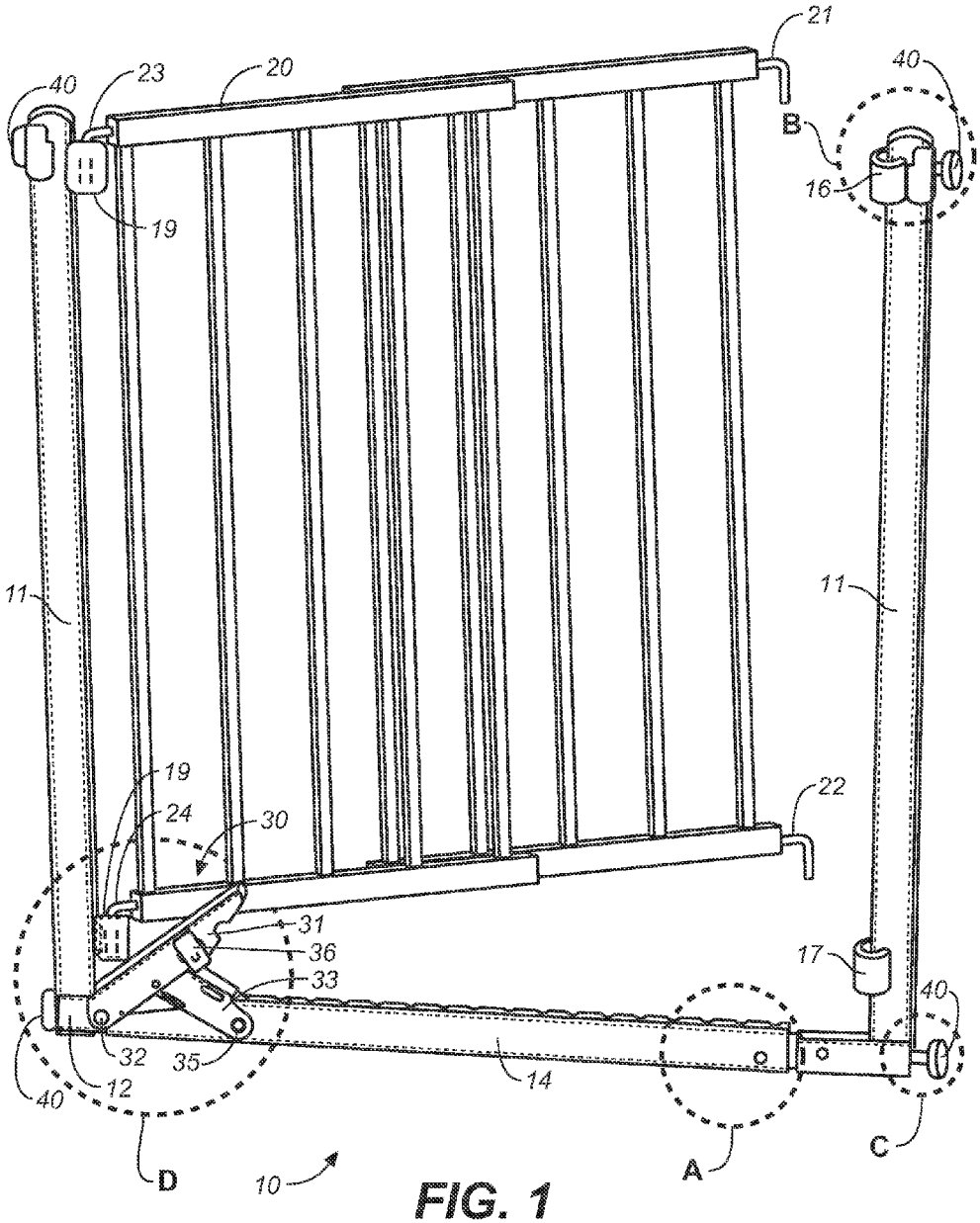
FIG. 1 and FIG. 1A are side views of the safety gate assembly with the door in the open and in the closed positions respectively.
Figure 1A:
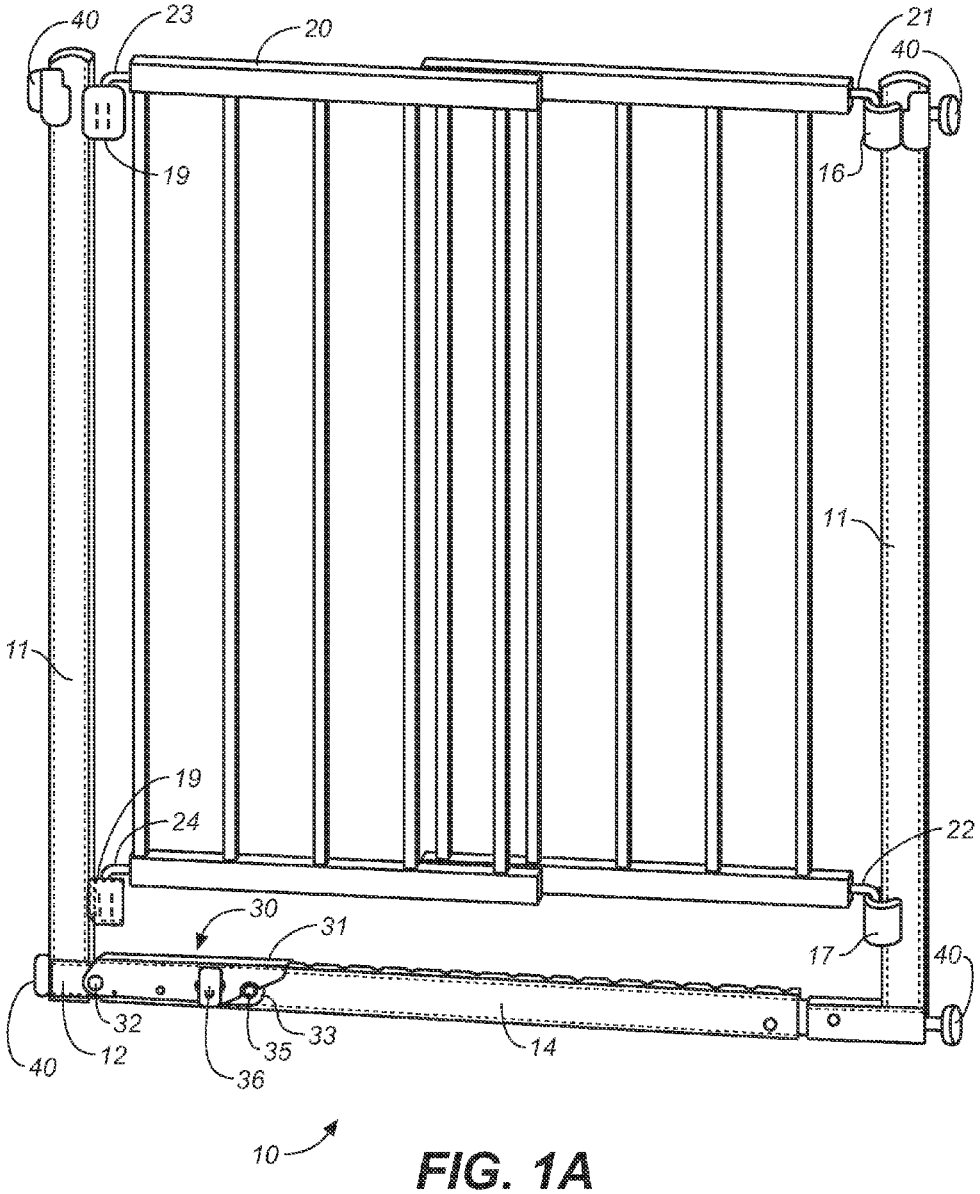

The safety gate of the invention is designed to be a quick, easy setup process for the consumer to install in a doorway or opening from 29.5" to 42" widths. It consists of a "U-frame" structural assembly 10 and an adjustable swinging door 20. The "U-frame" 10 is installed in the doorway and then the swinging adjustable gate is installed onto the "U-frame" by pivot means composed of a pair of hinge brackets 19 mounted on the interior side of frame and a pair of hinges mount on the door as is well known in the art. Frame 10 includes two generally vertically extending pillars 11, each pillar having a substantially perpendicular cross bar 12 and 13 attached to it and extending horizontally at the bottom end of the pillars to form the bottom of the U.

The frame further includes a hollow surround bar 14 that is positioned surrounding the horizontal cross bars so that each horizontal cross bar rests at least partially inside it and is able to move in a telescoping manner within it. The cross bars 12, 13 may be U-shaped in cross section and are attached to the vertically extending pillars so that the bottom of the U is uppermost, such that the "U" is in an upside down arrangement. In one embodiment, at least one of the cross bars, 13, is formed with an array of slots 18 in one side thereof, preferably the top side thereof. The slots are disposed in the cross bar in regular increments, preferably in increments of between 10 and 15 mm, more preferably in increments of between 12 to 13 mm. The cross bars and surround bar form part of a gross adjustment mechanism by which one of the pillars separates from the other pillar in these regular increments. The door, 20, is formed to span the interior of the frame and is pivotally connected to an interior side of one of the frame pillars via hinge brackets 19 to permit pivotal movement of the door with respect to the frame about a pivot axis as already described. The door is formed so as to be adjustable in the horizontal direction such that the width of the door can accommodate the varying widths of the frame. The frame is also provided with an upper latch receiver 16 and a lower latch receiver 17 and the door is provided with upper and lower latches 21 and 22 that are correspondingly positioned to mate with the latch receivers when the door is swung to its closed position in planer alignment with the frame.

Figure 2:
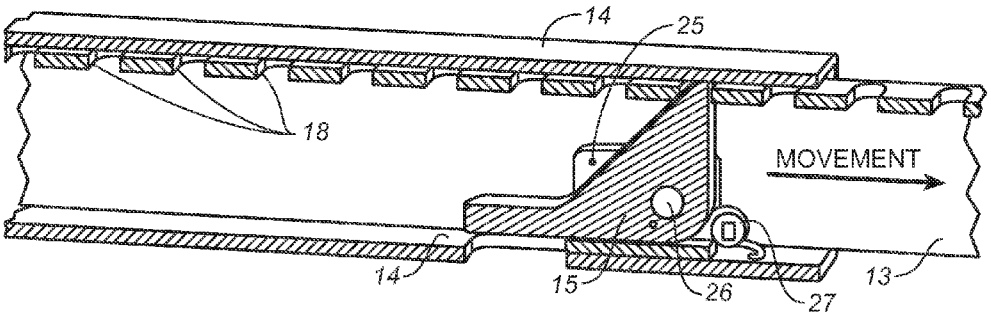
FIG. 2 is an exploded, cross-sectional view of one embodiment of the unidirectional locking means positioned in the area denoted A in FIG. 1.

As best seen in FIG. 2, the bottom of the U-frame has a gross adjustment feature whereby the uncatched cross bar (not shown) is able to separate from the slotted cross bar, 13, in increments of 13 mm (½" of an inch) by use of a ratcheting-like mechanism. In the embodiment shown in FIG. 2, a spring-loaded pawl 15 having a sloping side and a vertical side is pivotally mounted within surround bar 14 by means of a U-shaped pawl bracket 25 to which pawl pivot pin 26 is attached. Because the pawl has a sloping side and a vertical side, the pawl is allowed to pivot in one direction only. The pawl allows for the movement of surround bar when pivoted in the upward direction but prevents movement in the opposite direction because the pawl springs downward as the surround bar moves so the pawl engages with one of the slots 18 in the slot array. Torsion spring 27 is operatively connected to pawl 15 and pawl bracket 25 to provide this function and to orient and maintain the pawl vertically within surround bar 14.

Figure 3:
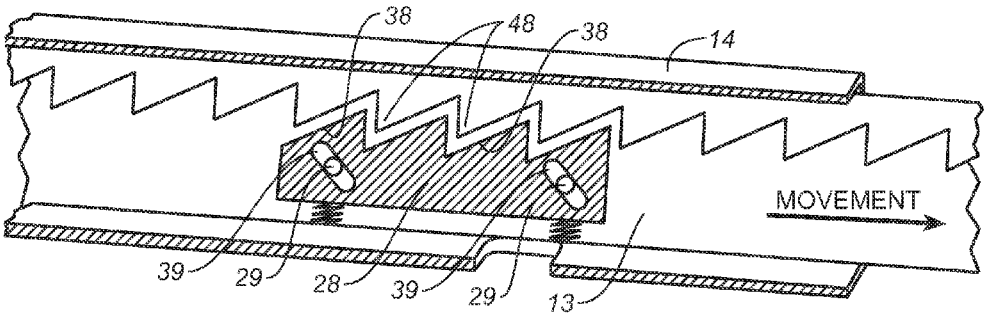
FIG. 3 is an exploded, cross-sectional view of another embodiment of the unidirectional locking means positioned in the area denoted A in FIG. 1.

In FIG. 3, there is shown a second embodiment of the gross adjustment mechanism. In this embodiment, the top of one of the cross bars is formed with depending saw teeth, 48, instead of slots. A spring-mounted linear pawl, 28, is positioned in the interior of surround bar 14 and mounted to the sides of the surround bar via pins 29. The linear pawl is formed with a pair of 45° angled guide slots, 39, through which the pins, 29, extend. As the catched cross bar moves linearly to widen the frame (i.e., moves to the right in the Figures), the saw teeth 48 of the catched cross bar glide over the corresponding saw teeth, 38, in the pawl as the pin mounted pawl slides linearly on a 45° angle. In this embodiment, because the pawl has a sloping side and a vertical, the pawl allows for movement of the cross bar in one direction only.

Figure 6:
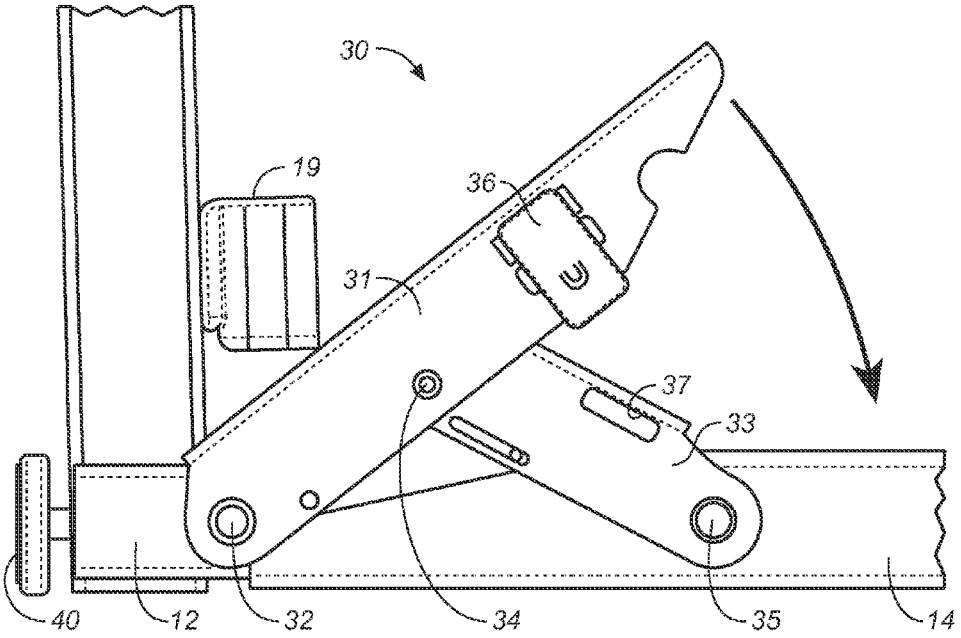
FIG. 6 and FIG. 6A are exploded side views of the area denoted D in FIG. 1 with the foot pedal in an open position and a closed position, respectively.
Figure 6A:
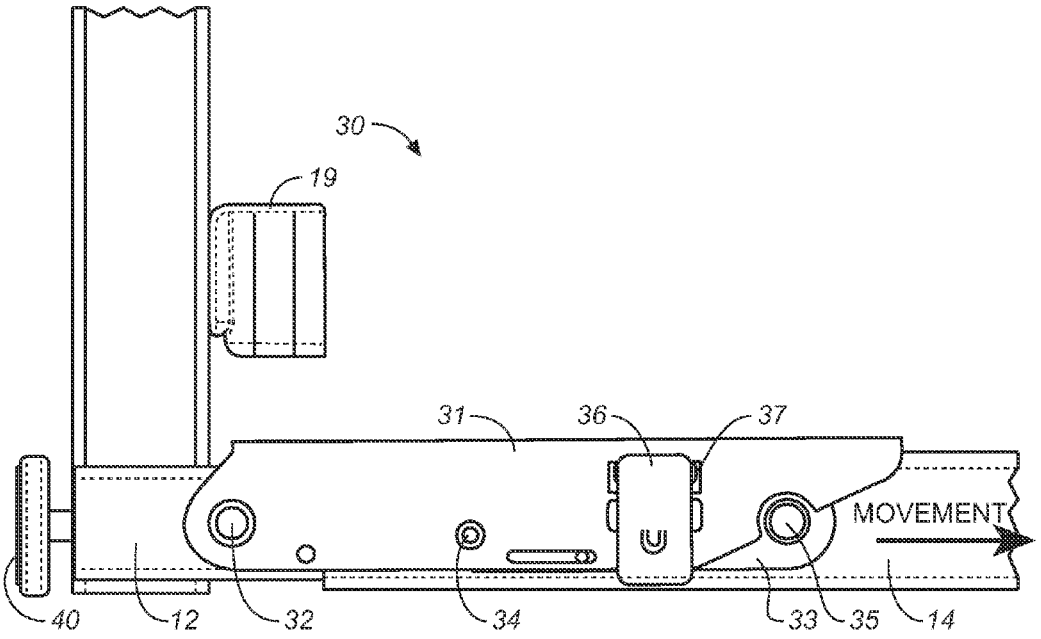

Referring now to FIG. 6 and FIG. 6A, the gate of the invention also includes a foot pedal assembly 30 including foot pedal 31 and linkage 33. Foot pedal 31 is connected to the sides of uncatched cross bar 12 by pivot pin 32 and to linkage 33 by pivot pin 34. Spring loaded finger locks 36 are provided on each side of the foot pedal. Linkage 33 is connected to the sides surround bar 14 by means of pivot pin 35 thereby forming a cantilever of the assembly. Linkage 33 is formed with a finger lock slots 37 disposed on each side of the linkage bar and positioned for receiving the finger locks on the foot pedal. When the foot pedal is depressed, it pivots downward and the uncatched cross bar 12 and surround bar 14 move outward, expanding the assembly by up to 18 mm to engage the vertical pillars with the vertical doorway surfaces. When depressed fully, finger locks 36 engage with finger lock slots 37 to maintain the foot pedal in it fully depressed position and to lock the frame in place against the doorway surface. When the user purposefully depresses both finger locks and releases, the lock springs open releasing the foot pedal from its fully depressed and locket position. The released foot pedal then pivots upward, which causes uncatched cross bar 12 and surround bar 14 to retract, removing the load off the bottom of the pillars which allows the user to remove the assembly from the doorway.

As best seen in FIGS. 4 and 5, pad assemblies are provided to minimize marring the vertical door or hall surfaces between which the safety gate is mounted. The two pillars, 11, are formed with upper and lower receiving holes in their outer sides. The pad assembly including pad 40 mounted on the head of threaded screw 41 is inserted into the hole in engagement with threaded nut 42 that is positioned within pillar 11 in a contiguous position with the receiving hole. This ensures grip to resist any pushing on the U-frame to dislodge it and provides a fine adjustment for gate assembly.

As shown in FIG. 5, one of the lower pad assemblies, specifically the lower pad assembly mounted on the vertical pillar opposite the foot pedal assembly, may be provided with a spring, 43, which deforms under load to take up compliance with the uncatched cross bar and the surround bar are expanded by the foot pedal. This spring 43, which is held in place within slotted cross bar 13 by spring perch 44 and spring stop 45 allows pad 40 to depress 24 mm under a load of 30 foot pounds. As the uncatched cross bar and surround bar are expanded by depression of the foot pedal, this pad makes contact with the doorway vertical surface and the spring 43 allows the bars to continue to expand, compressing the spring and keeping the pads 40 in contact with the passageway vertical surface. As the spring compresses, the load on the pads increases which ensures adequate friction between the frame of the gate and the doorway vertical surfaces.

Once the frame is secured in the doorway, the door 20 is installed by placing the hinge pins 23, 24 into the hinge brackets 19 on the frame and dropping the gate in a downward motion until it is fully seated. Next the width of the door is adjusted so that the door latches can be received in the upper and lower latch receivers of the frame. The door is now able to swing and be of use.

The invention claimed is:

1. A safety gate comprising (a) a frame including two generally vertically extending pillars, each of said pillars having a top end and a bottom end, and each of said pillars having a cross bar attached to the bottom end of the pillar and extending horizontally and substantially perpendicularly from the bottom end of the pillar, and a hollow surround bar being formed and positioned so that said cross bars rest at least partially inside the hollow surround bar, said cross bars being telescopingly movable relative to said hollow surround bar and horizontally movable, at least one of said cross bars being formed with an array of catches in one side thereof, the frame forming a U-shaped structure having an interior and being width adjustable;

(b) a door spanning the interior of the frame and pivotally connected to an interior side of one of said frame pillars for movement of the door about a pivot axis;

(c) means for engaging one of said catches in said array of catches and allowing horizontal, linear motion of said one of said cross bars relative to and within the surround bar only in a single direction to increase a width of the frame, said means for engaging one of said catches being positioned within said one of said cross bars; and (d) a cantilever foot pedal operatively connected to the surround bar and rotatable between an upward and open position and a downward and closed position to telescopingly move the surround bar relative to the other one of said cross bars to increase or decrease the width of the frame and to lock and unlock the frame.

2. The safety gate according to claim 1 wherein at least one of the vertically extending pillars is canted away from the other one of the vertically extending pillars 1° - 3° from vertical.

3. The safety gate according to claim 1, further comprising said foot pedal being positioned adjacent one of the pillars, a pad positioned outside the bottom end, of the other one of said pillars, and a spring positioned within said one of said cross bars and operatively connected to the pad such that when the foot pedal is moved toward the closed position the spring is compressed increasing a force applied to the pad.

4. The safety gate according to claim 3 further comprising top pads positioned on the vertically extending pillars and adapted to removably engage with a wall or doorway in which the safety gate is positioned.

5. The safety gate according to claim 4 further comprising a latch mechanism to releasably lock the door in a closed planer position in relation to the frame.

6. The safety gate according to claim 1 wherein the means for engaging one of said catches in said array of catches comprises a pawl.

7. The safety gate according to claim 6 wherein the array of catches comprise an array of slots.

* * * * *